US010847870B2

(12) United States Patent
Sharawi et al.

(10) Patent No.: US 10,847,870 B2
(45) Date of Patent: Nov. 24, 2020

(54) FREQUENCY RECONFIGURABLE MIMO ANTENNA WITH UWB SENSING ANTENNA

(71) Applicant: King Fahd University of Petroleum and Minerals, Dhahran (SA)

(72) Inventors: Mohammad S. Sharawi, Dhahran (SA); Rifaqat Hussain, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 15/995,982

(22) Filed: Jun. 1, 2018

(65) Prior Publication Data

US 2019/0372200 A1 Dec. 5, 2019

(51) Int. Cl.

| | |
|---|---|
| ***H01Q 1/24*** | (2006.01) |
| ***H01Q 5/321*** | (2015.01) |
| ***H01Q 21/28*** | (2006.01) |
| ***H01Q 1/38*** | (2006.01) |

(52) U.S. Cl.

CPC ..... *H01Q 1/243* (2013.01); *H01Q 1/38* (2013.01); *H01Q 5/321* (2015.01); *H01Q 21/28* (2013.01)

(58) Field of Classification Search

CPC ..... H01Q 7/005; H01Q 13/103; H01Q 13/16; H01Q 13/10; H01Q 3/443; H01Q 13/18; H01Q 7/00; H01Q 21/064; H01Q 21/0043; H01Q 21/005; H01Q 21/0056; H01Q 21/0062

USPC ..... 343/745, 767–771

See application file for complete search history.

(56) References Cited

U.S. PATENT DOCUMENTS

| | | | | |
|---|---|---|---|---|
| 9,716,312 | B2 | 7/2017 | Chen | |
| 9,837,702 | B2 | 12/2017 | Sharawi et al. | |
| 9,893,715 | B2 * | 2/2018 | Zachara | H01Q 21/28 |
| 2005/0280580 | A1 | 12/2005 | Lin | |
| 2016/0261050 | A1 * | 9/2016 | Sharawi | H01Q 1/243 |

OTHER PUBLICATIONS

Hussain, Rifaqat, et al. ; Annular slot-based miniaturized frequency-agile MIMO antenna system ; Jul. 12, 2017 ; IEEE Antennas and Wireless Propagation Letters, vol. 16, ; 4 pages.

Zhang, Yan, et al. ; Compact ultrawideband (UWB) slot antenna with wideband and high isolation for mimo applications ; Jul. 23, 2014 ; Progress in Electromagnetics Research C, vol. 54, 9-16 ; 8 pages.

* cited by examiner

*Primary Examiner* — Binh B Tran

(74) *Attorney, Agent, or Firm* — Oblon, McClelland, Maier & Neustadt, L.L.P.

(57) ABSTRACT

A dielectric substrate for a configurable antenna has an upper surface and an opposing lower surface. An upper conductor patch is disposed on the upper surface of the substrate and a lower conductor patch is disposed on the lower surface of the substrate. A sensing antenna is formed in the upper conductor patch. An upper set of slot antennas is formed in the upper conductor patch and a lower set of slot antennas is formed in the lower conductor patch. Each of the slot antennas is loaded with a variable reactance component.

20 Claims, 12 Drawing Sheets

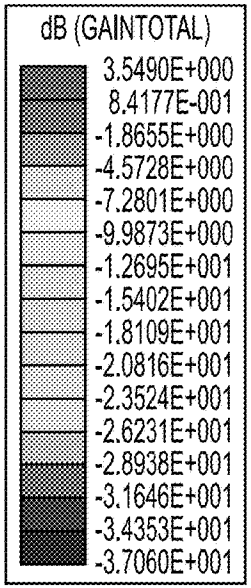
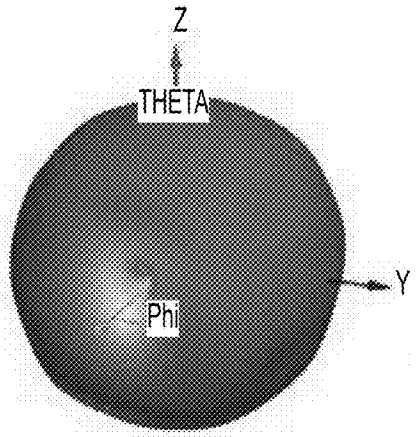
FIG. 6A
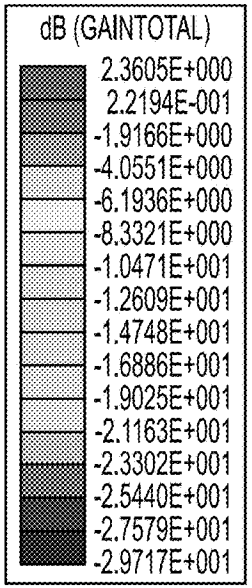
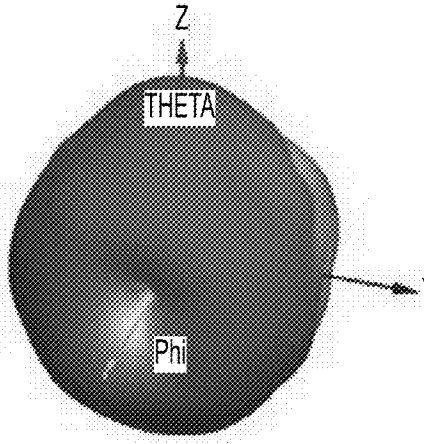
FIG. 6C
FIG. 6B
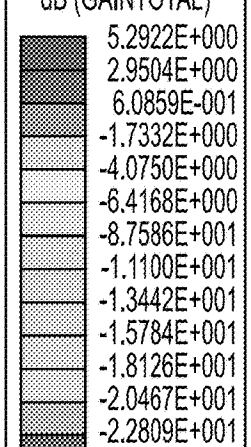
FIG. 6D

FREQUENCY RECONFIGURABLE MIMO ANTENNA WITH UWB SENSING ANTENNA

BACKGROUND

Field of the Invention

This invention is related to the field of wide-band wireless communications and, more specifically, to reconfigurable multiple-input multiple-output (MIMO) antenna systems for cognitive radio platforms in compact wireless devices.

Description of Related Art

As new features and services are added to wireless devices and mobile terminals in modern wireless communication systems, high data rates and efficient spectral utilization are indispensable. High data rates can be achieved by utilizing multiple-input multiple-output (MIMO) systems covering several frequency bands. MIMO is a technique by which, among other things, a data signal is split into multiple streams and each stream is transmitted from a different transmit antenna. If these signals arrive at receiver antennas with sufficiently different spatial signatures and the receiver has accurate channel state information (CSI), it can separate these streams into parallel transmission/reception channels.

Spectral efficiency may be achieved using a system such as cognitive radio (CR), by which a wireless communication transceiver can determine which communication channels are in use and which are not, and can utilize vacant channels while avoiding occupied ones. A CR senses unoccupied or under-utilized frequency bands then changes the operating frequency band to the unoccupied band, thus achieving better spectral utilization. A CR based system must be aware of its environment by sensing spectral usage and must have the capability to switch operating points among different unoccupied frequency bands. A CR based system typically implements various features including spectral sensing, switching between different frequency bands and transmitter power level adjustment.

The radio front end of a CR typically consists of two antennas, (1) an ultra-wideband (UWB) sensing antenna and (2) a reconfigurable communication antenna. A UWB sensing antenna is utilized to scan a wide frequency band while the reconfigurable antenna dynamically changes the basic radiating characteristic of the antenna system to utilize the available bandwidth.

Accordingly one aspect of the present disclosure is to provide a configurable antenna apparatus that exhibits wide tuning range operation is suitable for use in wireless handheld devices and mobile terminals in second generation cognitive radio (CR) platforms for cellular communication.

SUMMARY

A dielectric substrate for a configurable antenna has an upper surface and an opposing lower surface. An upper conductor patch is disposed on the upper surface of the substrate and a lower conductor patch is disposed on the lower surface of the substrate. A sensing antenna is formed in the upper conductor patch. An upper set of slot antennas is formed in the upper conductor patch and a lower set of slot antennas is formed in the lower conductor patch. Each of the slot antennas is loaded with a variable reactance component.

In one aspect of the invention, the slot antennas are annular slot antennas, each having a varactor diode connected across the corresponding slot as the variable reactance component.

In another aspect of the invention, each of the slot antennas includes a central void lacking conductive material.

In another aspect of the invention, a transmission line is disposed on an opposing side of the substrate of each of the slot antennas.

In another aspect of the invention, the upper conductor patch comprises a trapezoidal section forming a monopole antenna as the sensing antenna, the lower conductor patch being the reference plane of the monopole antenna.

In another aspect of the invention, the upper set of slot antennas is removed from the trapezoidal section.

In another aspect of the invention, a biasing circuit for the reactance component of each of the slot antennas is disposed on the substrate.

BRIEF DESCRIPTION OF THE DRAWINGS

FIGS. 6A-6D illustrate simulated 3-D gain patterns at four different frequency bands of a UWB sensing antenna with which the present inventive concept can be embodied.

DETAILED DESCRIPTION

Figure 1A:
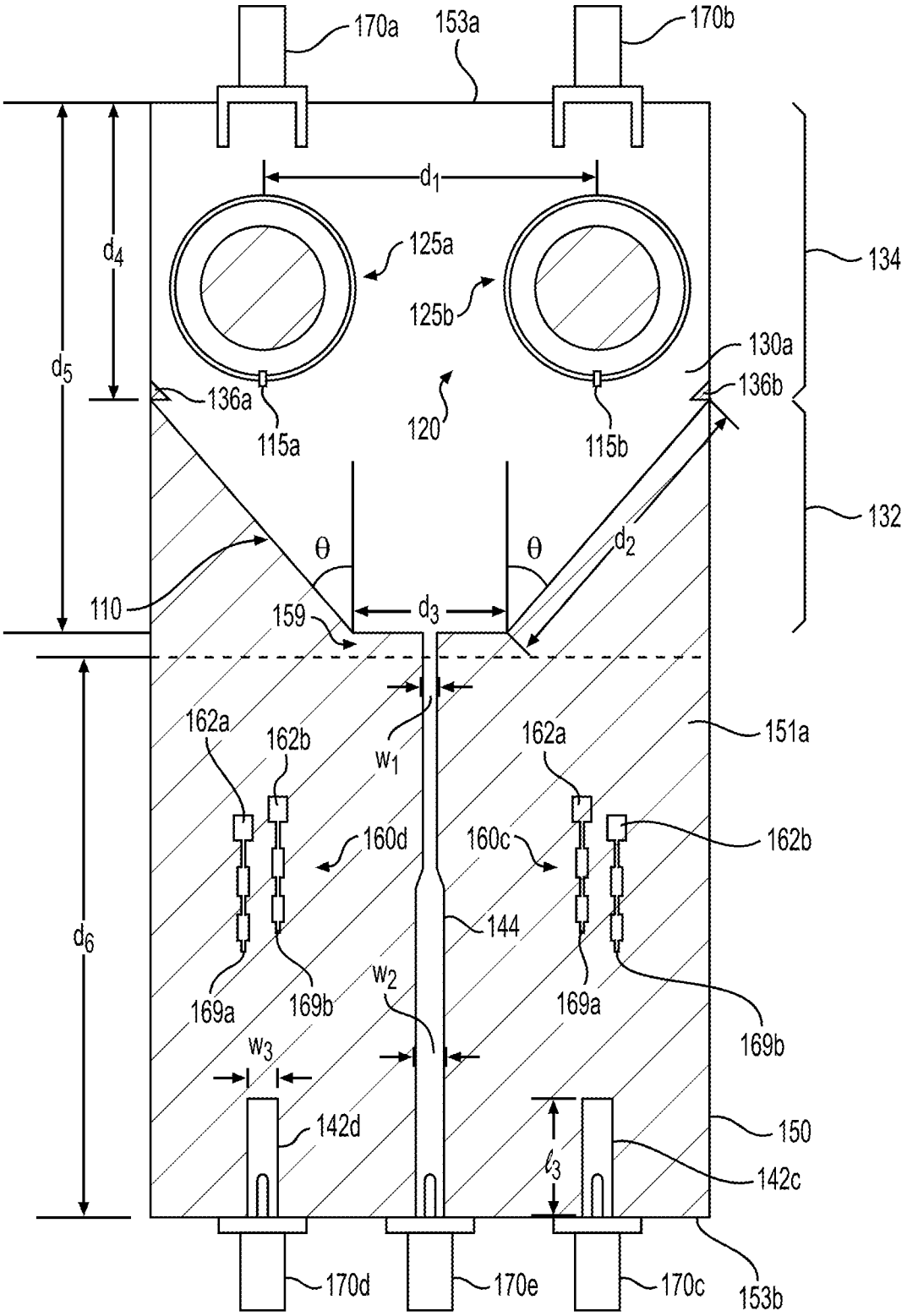
FIGS. 1A-1B are illustrations of opposing sides of an exemplary planar antenna system by which the present inventive concept can be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments. Particular quality or fitness of the examples indicated herein as exemplary is neither intended nor should be inferred.

Figure 1B:
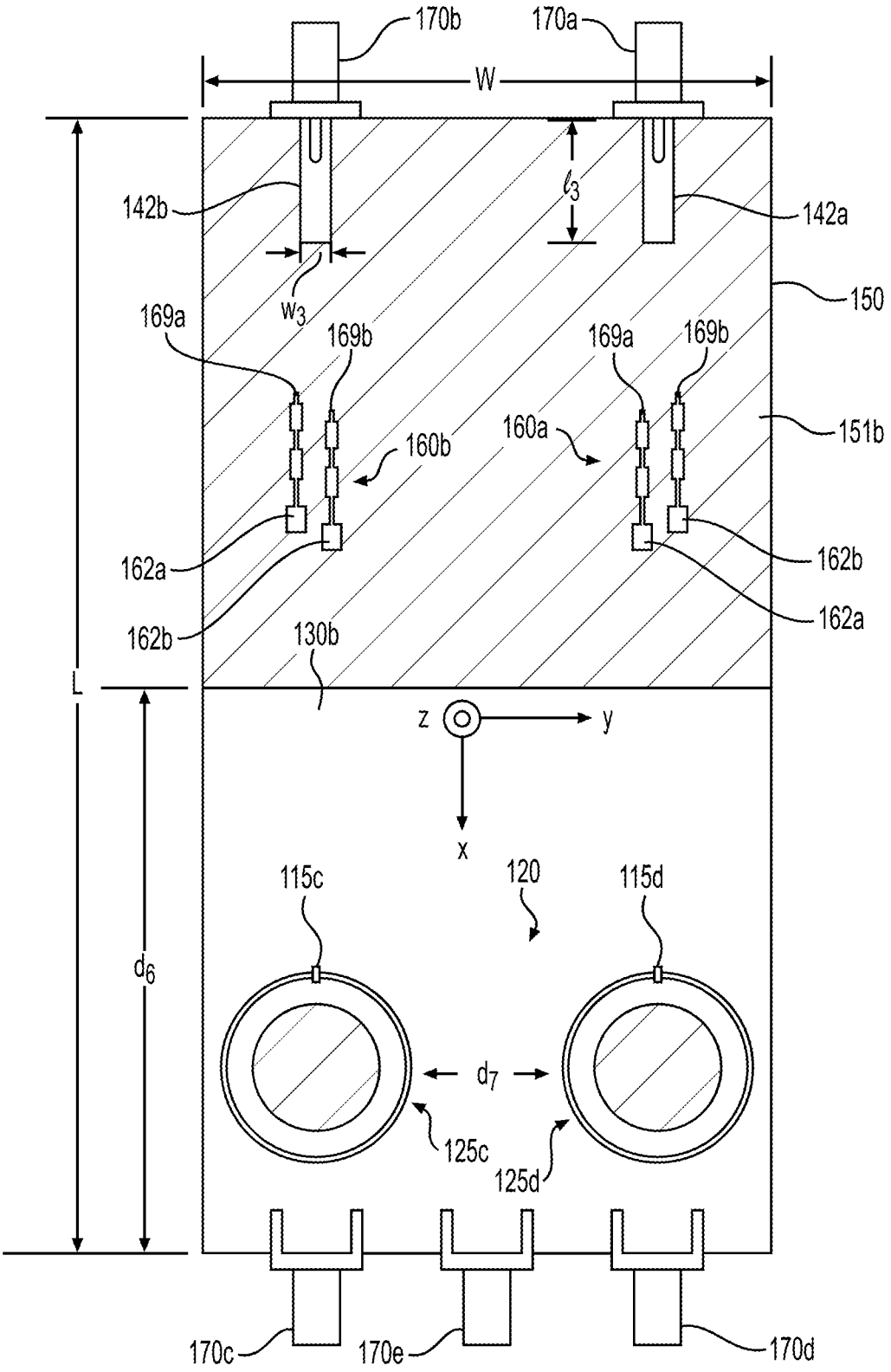

FIG. 1A and FIG. 1B, collectively referred to herein as FIG. 1, are illustrations of opposing surfaces 151*a* and 151*b* of an exemplary planar antenna system 100 by which the present invention can be embodied. Planar antenna system 100 combines an ultra-wideband (UWB) sensing antenna 110 with a frequency agile multiple-input multiple-output (MIMO) antenna system 120 on a single planar substrate 150 of length L, width W and thickness T. MIMO antenna system 120 comprises a set of annular slot antenna elements 125*a*-125*d*, representatively referred to as MIMO antenna element(s) 125, which are described in more detail below. Planar antenna system 100 may be utilized in a cognitive radio (CR) or similar system.

Example planar antenna system 100 comprises two conducting planes 130*a* and 130*b*, representatively referred to herein as conducting plane(s) 130, which are disposed on opposing surfaces 151*a* and 151*b* and at opposing ends 153*a* and 153*b* of a dielectric substrate 150. Conducting planes 130 may be formed of a conductive material, such as copper. Each conducting plane 130 occupies the width W of substrate 150. Conducting plane 130*a* extends a distance $d_5$ from substrate end 153*a* and conducting plane 130*b* extends a distance $d_6$ from substrate end 153*b*. Distances $d_5$ and $d_6$ may be chosen so as to leave a narrow gap 159 between the distal end of conducting plane 130*a* and the distal end of conducting plane 130*b*. This gap may be dimensioned for feed point tuning of UWB sensing antenna 110 by a reactive impedance created in the gap.

Conducting planes 130 may be electrically connected to outer conductors of coaxial connectors 170*a*-170*e*, representatively referred to herein as coaxial connectors 170. The center conductors of coaxial connectors 170 may be electrically connected to microstrip transmission lines that feed the antennas of planar antenna system 100: center conductor of coaxial connector 170*a* is electrically coupled to microstrip transmission line 142*a*; center conductor of coaxial connector 170*b* is electrically coupled to microstrip transmission line 142*b*; center conductor of coaxial connector 170*c* is electrically coupled to microstrip transmission line 142*c*; center conductor of coaxial connector 170*d* is electrically coupled to microstrip transmission line 142*d* and center conductor of coaxial connector 170*e* is electrically coupled to microstrip transmission line 144. Microstrip transmission lines 142*a*-142*d* are representatively referred to herein as microstrip transmission line(s) 142. It is to be understood that connectors other than coaxial connectors 170 may be used in embodiments of the present invention to connect planar antenna system 100 with external radio components. The outer conductor of coaxial connectors 170 may be electrically connected to ground in which case conducting planes 130 serve as ground planes. However, the present invention is not so limited.

Microstrip transmission lines 142 have a width $w_3$ and length $l_3$ and are positioned to be electromagnetically coupled to corresponding MIMO antenna elements 125 from the opposing side of substrate 150. The width $w_3$ and length $l_3$ may be selected in a conventional fashion to realize a characteristic impedance, e.g., 50Ω of the corresponding microstrip transmission lines 142 when loaded by MIMO antenna elements 125. Microstrip transmission line 144 is electrically coupled to UWB sensing antenna 110 and may be likewise constructed to realize a characteristic impedance. In certain embodiments, microstrip transmission line 144 is tapered from a width $w_2$ to a width $w_1$ for purposes of impedance matching. The reference plane for microstrip transmission lines 142*a* and 142*b* is conducting plane 130*a* and the reference plane for microstrip transmission lines 142*c*, 142*d* and 144 is conducting plane 130*b*. Conducting plane 130*b* also serves as the reference plane for UWB sensing antenna 110.

As illustrated in FIG. 1A, the shape of example conducting plane 130*a* can be described as being formed from a trapezoidal section 132 and a rectangular section 134. Exemplary rectangular section 134 extends the width W of substrate 150 and extends a distance $d_4$ from substrate end 153*a*. Exemplary trapezoidal section 132 has a base that extends the width W of substrate 150, located at notches 136*a* and 136*b*, and an opposing base of dimension $d_3$ at the antenna's feed point. The dimensions of trapezoidal section 132, e.g., distance between bases and angles θ of the legs with respect to the longitudinal axis of the substrate 150, are selected to define a wideband resonant antenna structure for UWB sensing antenna 110.

On the outer edges of substrate 150 where trapezoidal section 132 and rectangular section 134 meet are a set of notches 136*a* and 136*b*, representatively referred to herein as notch(es) 136. Notches 136 serve to widen the bandwidth of UWB sensing antenna 110.

Figure 2A:
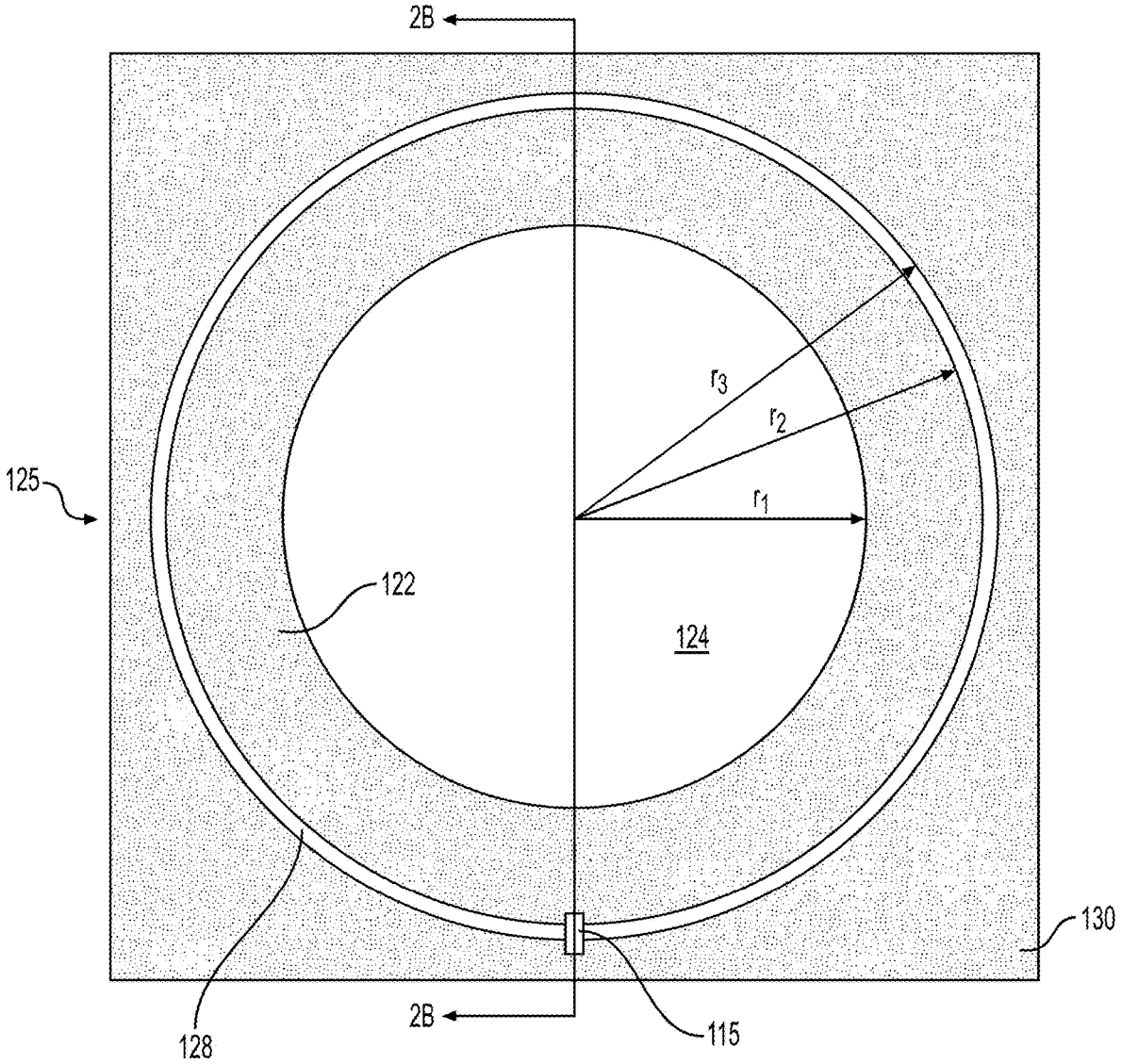
FIGS. 2A-2B are illustrations of a single multiple-input multiple-output (MIMO) antenna element with which the present inventive concept can be embodied.
Figure 2B:
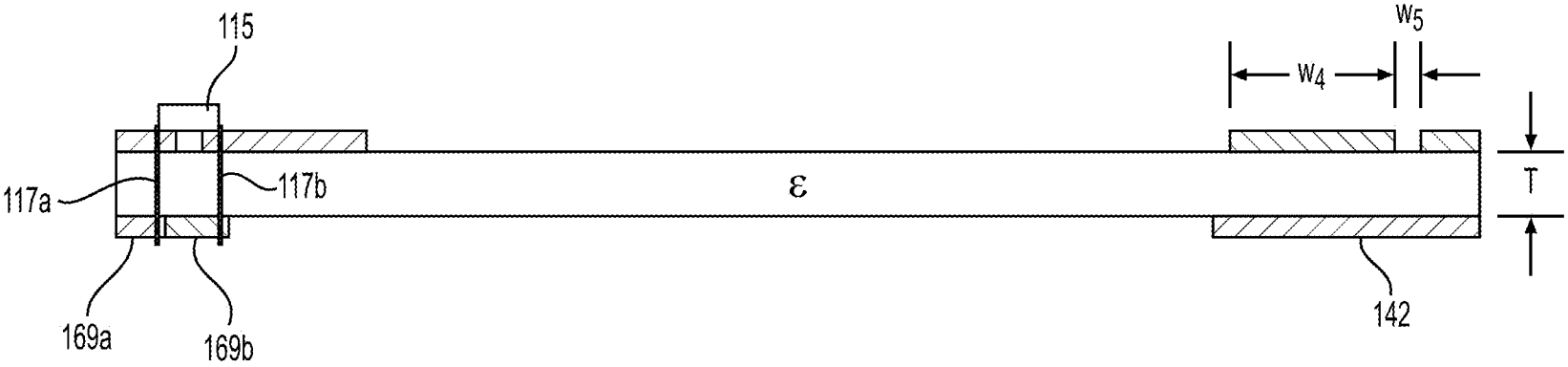

FIGS. 2A-2B, collectively referred to herein as FIG. 2, depict a detailed view of an example MIMO antenna element 125. FIG. 2B is a cross-sectional view of antenna element 125 taken at the 2B section lines illustrated in FIG. 2A. It is to be understood that FIG. 2 is intended to provide a schematic view of antenna elements 125 and is not drawn to scale. Example numerical dimensions of a specific embodiment of planar antenna system 100 are provided below.

As illustrated in FIG. 2, each MIMO antenna element 125 comprises a central void 124 that acts as a defective ground structure about which electromagnetic fields are generated when excited by a signal on transmission line 142. Each central void 124 may be of a radius $r_1$ and may be surrounded by a conductive annular ring 122 of width $w_4=r_2-r_1$. Annular ring 122 may itself be delineated from conducting plane 130 by an annular slot 128 of width $w_5=r_3-r_2$. Central void 124 may be appropriately sized and positioned in conducting plane 130 to resonate at a predetermined design frequency. Central voids 124 may be dimensioned to improve the impedance bandwidth of UWB sensing antenna 110 as well.

Annular slot 128 may be suitably sized and positioned to load the resonator formed from central void 124 with a predetermined reactance. Such reactance is made tunable by a variable reactance element, such as a varactor 115, illustrated in FIG. 1 as varactors 115*a*-115*d*. As those skilled in the art will attest, varactors are devices whose capacitance is a function of a reverse bias voltage applied thereto. To that end, biasing networks 160*a*-160*d*, representatively referred to herein as biasing network(s) 160, are electrically coupled to varactors 115*a*-115*d*, respectively. Varactor 115 may be electrically coupled to opposing sides of annular slot 125 and to biasing networks 160 by shorting posts 117*a* and 117*b* at terminals 169*a* and 169*b*, respectively.

Figure 3:
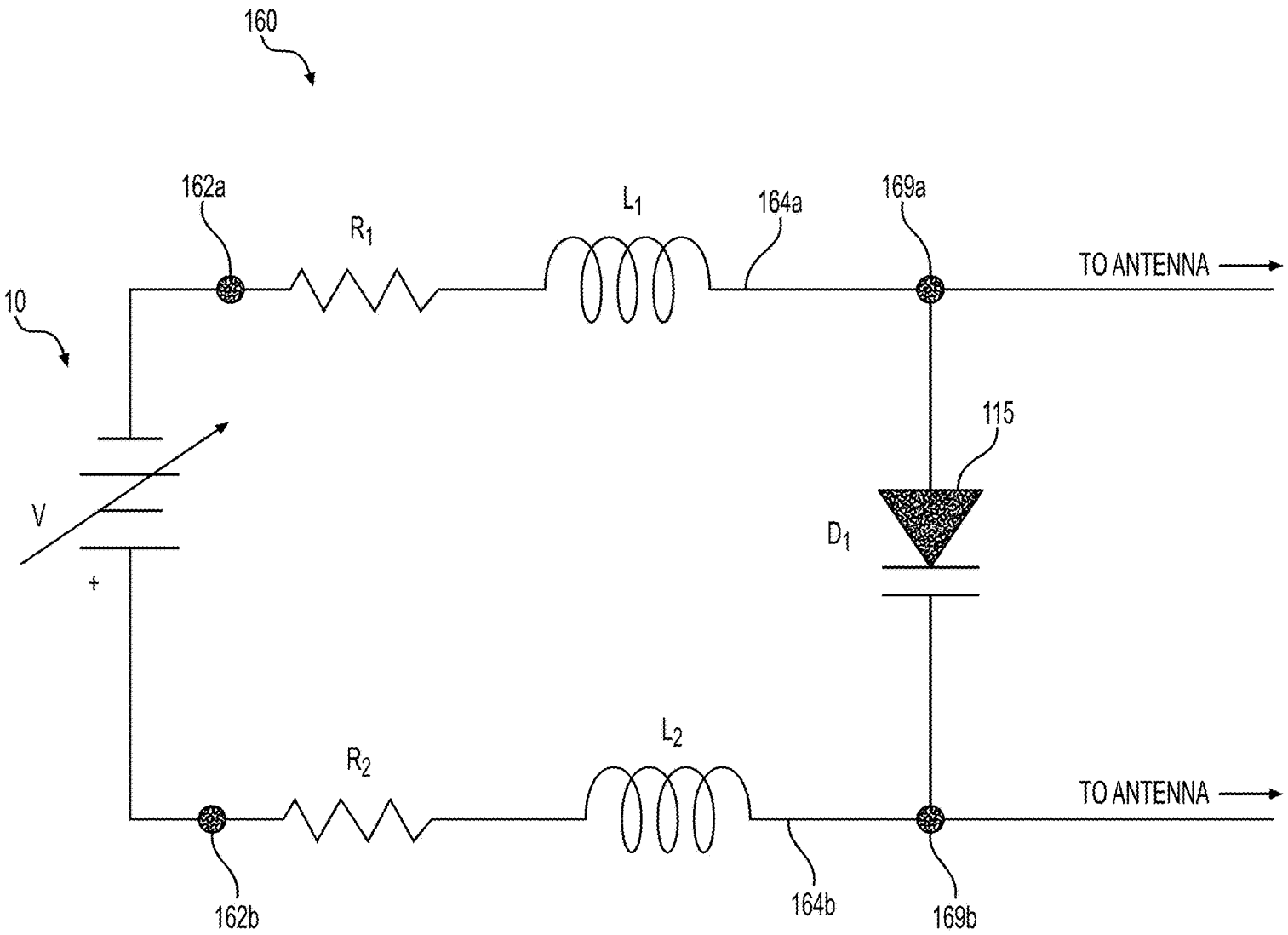
FIG. 3 is a schematic diagram of a tuning circuit with which the present inventive concept can be embodied.

FIG. 3 is a schematic diagram of biasing networks 160 and associated varactors 115. As illustrated in the figure, each biasing network 160 comprises a pair of resistor-inductor (RL) circuits 164*a* and 164*b*, representatively referred to herein as RL circuits(s) 164, electrically interposed between a respective set of terminals: 162*a* and 169*a* for RL circuit 164*a*, and 162*b* and 169*b* for RL circuit 164*b*. Terminals 169*a* and 169*b* are electrically coupled to opposing terminals of varactor 115 and terminals 162*a* and 162*b* are electrically coupled to opposing terminals of a DC power supply 10. DC power supply 10 provides a variable DC voltage that imposes a reverse bias on varactor 115, which manifests itself as a variable capacitance across the annular slot 128 of the corresponding MIMO antenna element 125. A biasing network 160 may be deployed at each MIMO antenna element 125 of planar antenna system 100, as illustrated in FIG. 1.

Having described various structural features of embodiments of the present invention, a specific example will now be provided to demonstrate certain operational characteristics of an embodiment of the present invention. In one embodiment, planar antenna system 100 is constructed in an RO-4350 substrate with a relative permittivity ($\varepsilon_r$) of 3.48. With a design wavelength of 50 mm, the various dimensions of planar antenna system 100 are W=60 mm, L=120 mm, T=1.5 mm, $d_1$=36 mm, $d_2$=33.45 mm, $d_3$=16 mm, $d_4$=32 mm, $d_5$=55.65 mm, $d_6$=59.8 mm, $d_7$=15.5 mm, $w_1$=1.5 mm, $w_2$=3 mm, $w_3$=3.1 mm, $w_4$=1.15 mm, $w_5$=0.5 mm, $l_3$=13 mm, $r_1$=8.5 mm, $r_2$=9.65 mm, $r_3$=10.1 mm and 0=45°. Conducting planes 130 are connected to electrical ground, such as when the outer conductors of coaxial connectors 170 are grounded. Accordingly, conducting planes 130 serve as ground planes. Parametric sweeps may be performed to optimize the various lengths of the UWB antenna including the length of the microstrip feed line 142. Parametric sweeps may also be performed for varactor diode placement on the specific location to reactively load the slot. The current position of varactor diode has maximal effect on the antenna resonance. The varactor diodes used are type SMV 1233. The varactor diode terminals are connected to a biasing circuit 160 using two shorting posts 117*a* and 117*b*, as shown FIG. 2.

The biasing circuitry 160, as shown in FIG. 3, consists of inductors L1 and L2 of 1 μH and resistors R1 and R2 of 2.1kΩ. The same biasing circuitry is used to bias all varactor diodes. The varactor diodes are reverse biased by applying variable voltage across terminals 162*a* and 162*b*. The diodes are utilized to tune the resonance frequency over a wide operation band.

Figure 4:
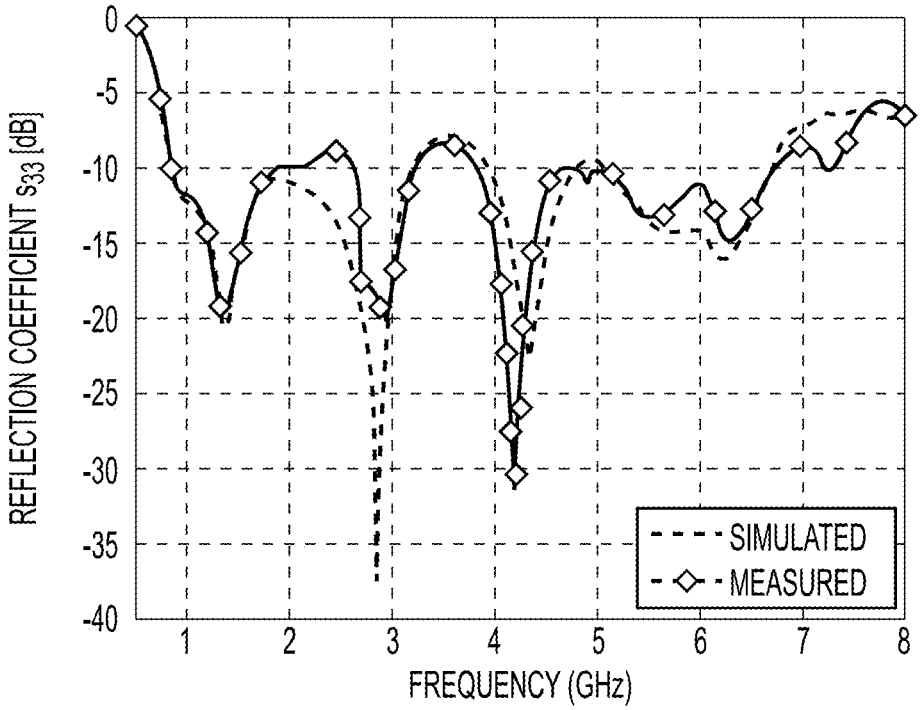
FIG. 4 is a graphical depiction of simulated and measured reflection coefficients curves of an ultra-wideband (UWB) sensing antenna with which the present inventive concept can be embodied.
Figure 5:
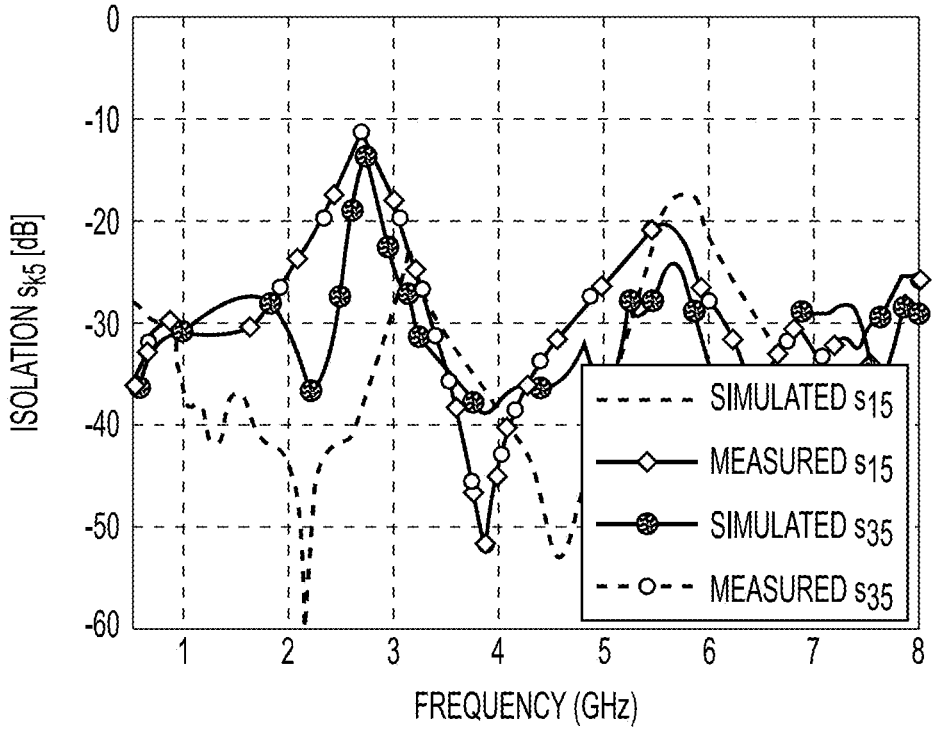
FIG. 5 is a graphical depiction of isolation between a UWB sensing antenna and reconfigurable MIMO antenna elements with which the present inventive concept can be embodied.

Using the dimensions and characteristics described above, example UWB sensing antenna 110 realizes frequency coverage from 0.75 to 7.65 GHz. The simulated and measured reflection coefficients curves of the UWB antenna are given in FIG. 4. Good agreement between simulated and measured results is obtained. The reconfigurable slot antenna elements are integrated within the monopole structure and it is hence useful to analyze the mutual coupling between them. FIG. 5 shows the isolation between UWB sensing antenna 110 and reconfigurable MIMO antenna elements 125 (between UWB sensing antenna 110 & MIMO antenna element 125*a* and between UWB sensing antenna 110 & MIMO antenna element 125*c*). Good isolation results are observed with a worst case isolation of 12 dB in the entire resonance band. FIGS. 6A-6D illustrates simulated 3-D gain patterns of the UWB sensing antenna 110 at four different frequency bands: 1.5 GHz, 2.0 GHz, 3.0 GHz and 4.0 GHz, respectively.

Figure 7:
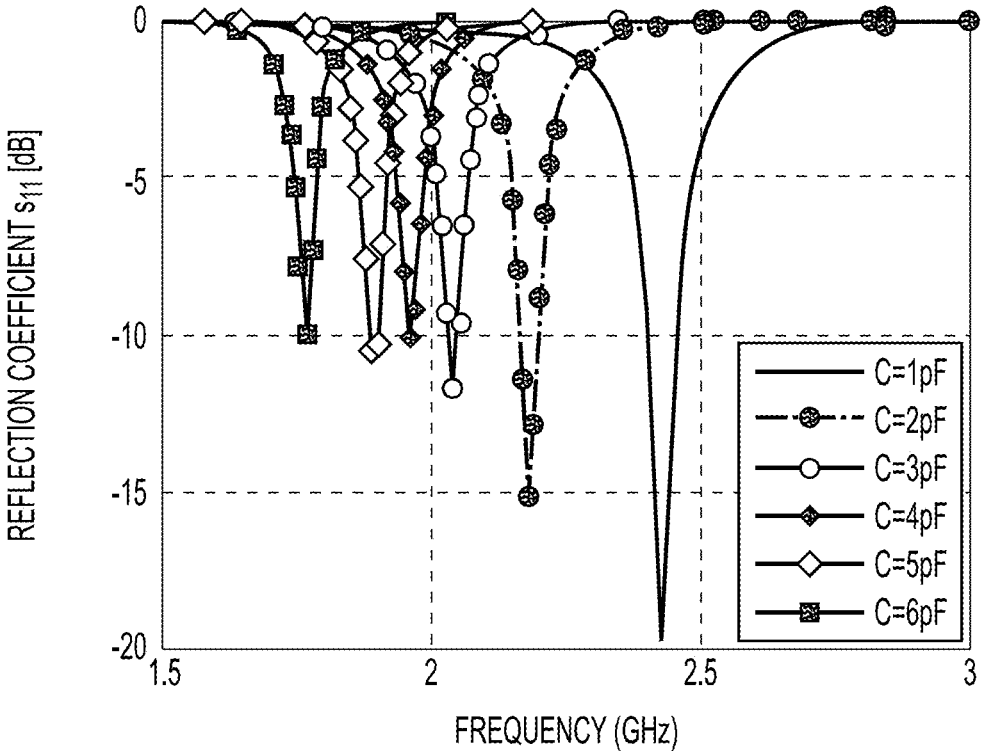
FIG. 7 depicts simulated reflection coefficients of an example MIMO antenna element with which the present inventive concept can be embodied.
Figure 8:
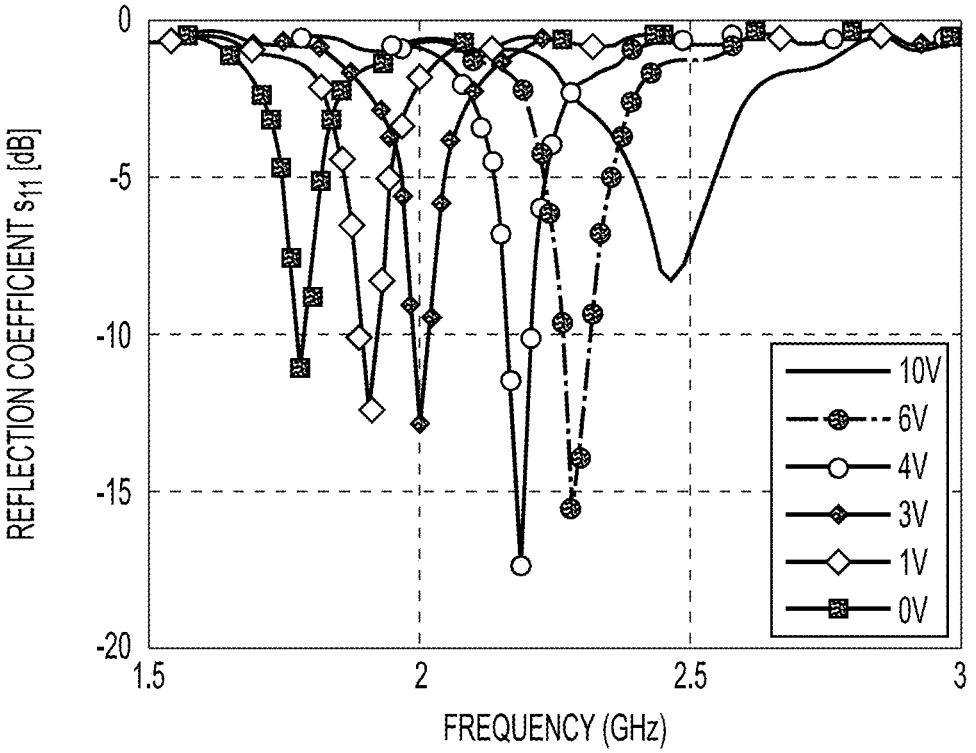
FIG. 8 depicts measured reflection coefficients of an example MIMO antenna element with which the present inventive concept can be embodied.
Figure 9:
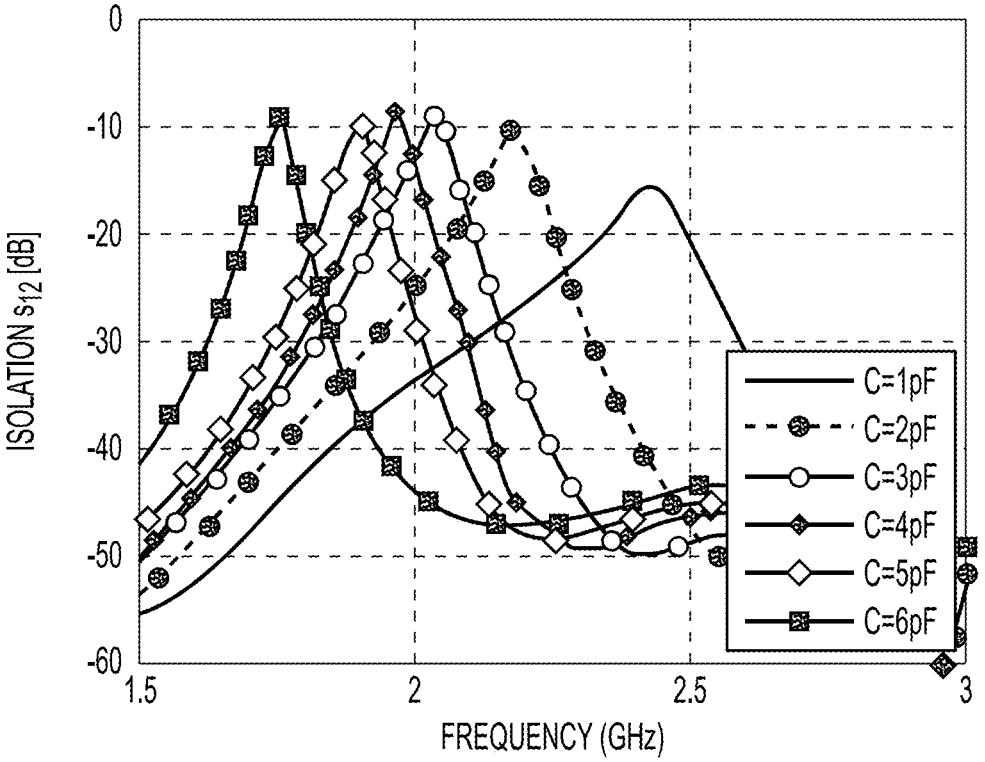
FIG. 9 depicts simulated isolation curves between MIMO antenna elements with which the present inventive concept can be embodied.
Figure 10:
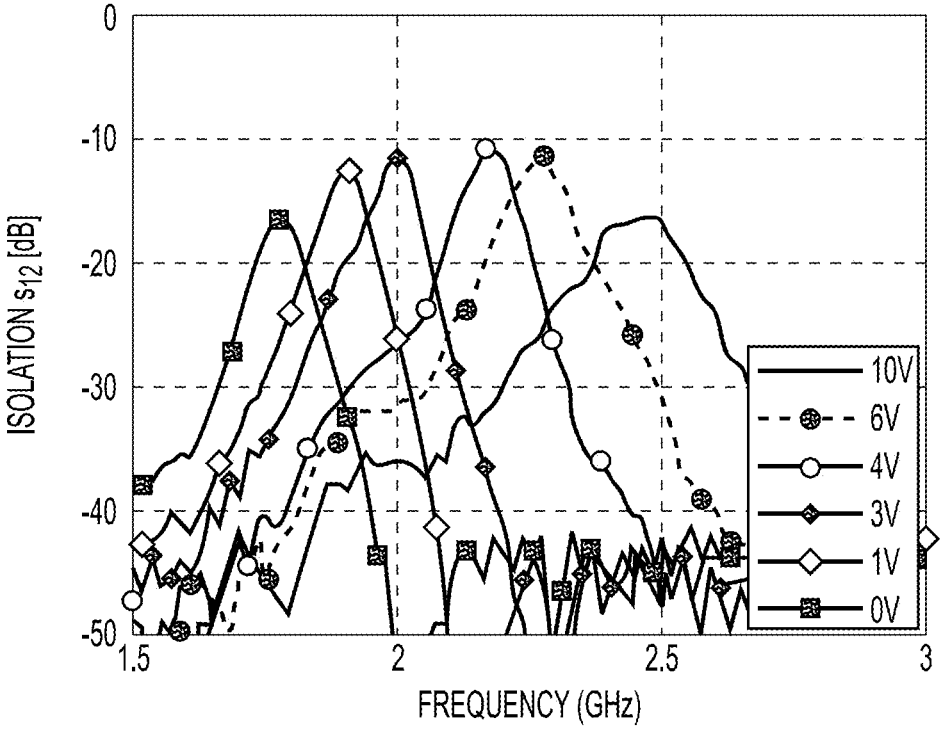
FIG. 10 depicts measured isolation curves between MIMO antenna elements with which the present inventive concept can be embodied.
Figure 11A:
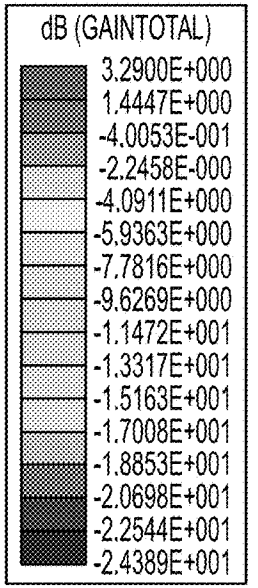
FIGS. 11A-11D depict 3D gain patterns of a reconfigurable MIMO antenna system with which the present inventive concept can be embodied.
Figure 11A:
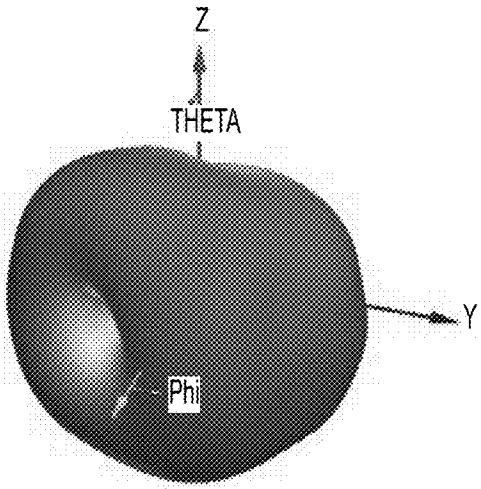
Figure 11B:
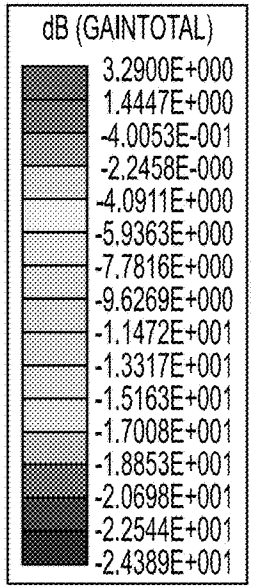
Figure 11B:
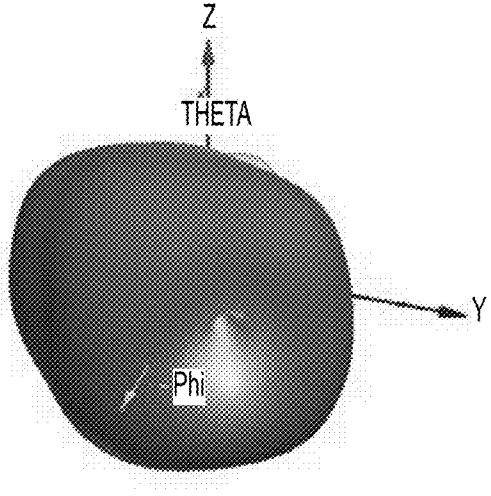
Figure 11C:
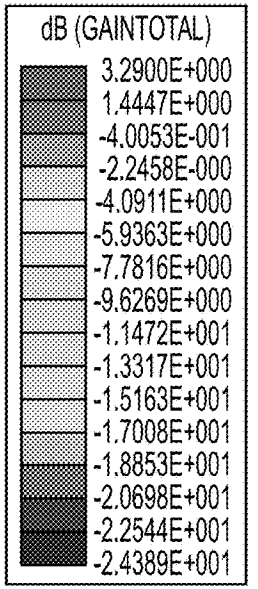
Figure 11C:
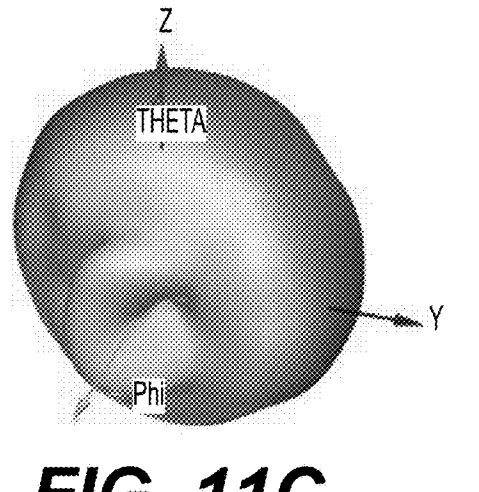
Figure 11D:
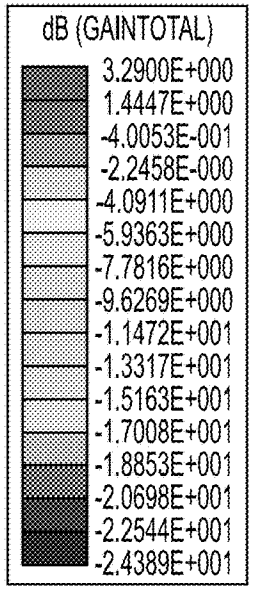
Figure 11D:
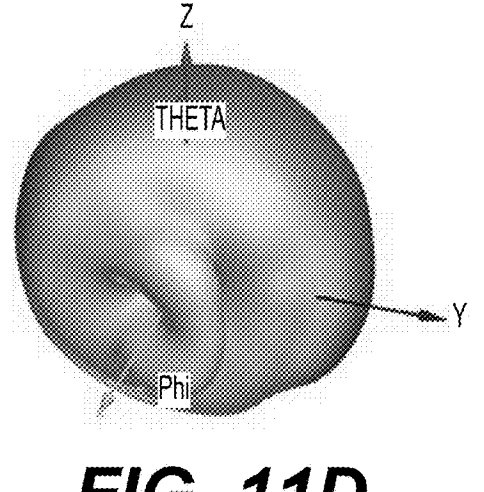

For annular slot based MIMO antenna operation, the varactor diode reverse bias voltage is varied between 0-15 volts. The resonating frequency is smoothly changed over the frequency band 1750-2480 MHz. The capacitance of the diode is varied from 1 pF to 6 pF. A significant bandwidth is achieved at all resonating bands. The minimum −6 dB operating bandwidth is 50 MHz. The simulated reflection coefficients are shown in FIG. 7 for while measured reflection coefficients are shown in FIG. 8. The simulated and measured isolation curves between MIMO antenna element 125*a* and MIMO antenna element 125*b* are shown in FIG. 9 and FIG. 10, respectively. The 3D gain patterns of the proposed reconfigurable MIMO antenna system are computed using High Frequency Structure Simulator (HFSS). The gain patterns for four antenna elements at 2040 MHz are shown in FIGS. 11A-11D.

The example MIMO antenna system may be tuned over wide and continuous frequency bands from 1.75 GHz to 2.48 GHz. The MIMO antenna covers the well-known frequency standards of GSM1800/LTE/UMTS/WLAN along with several others. The MIMO antenna system is compact and suitable for CR platforms in wireless handheld devices.

Figure 12:
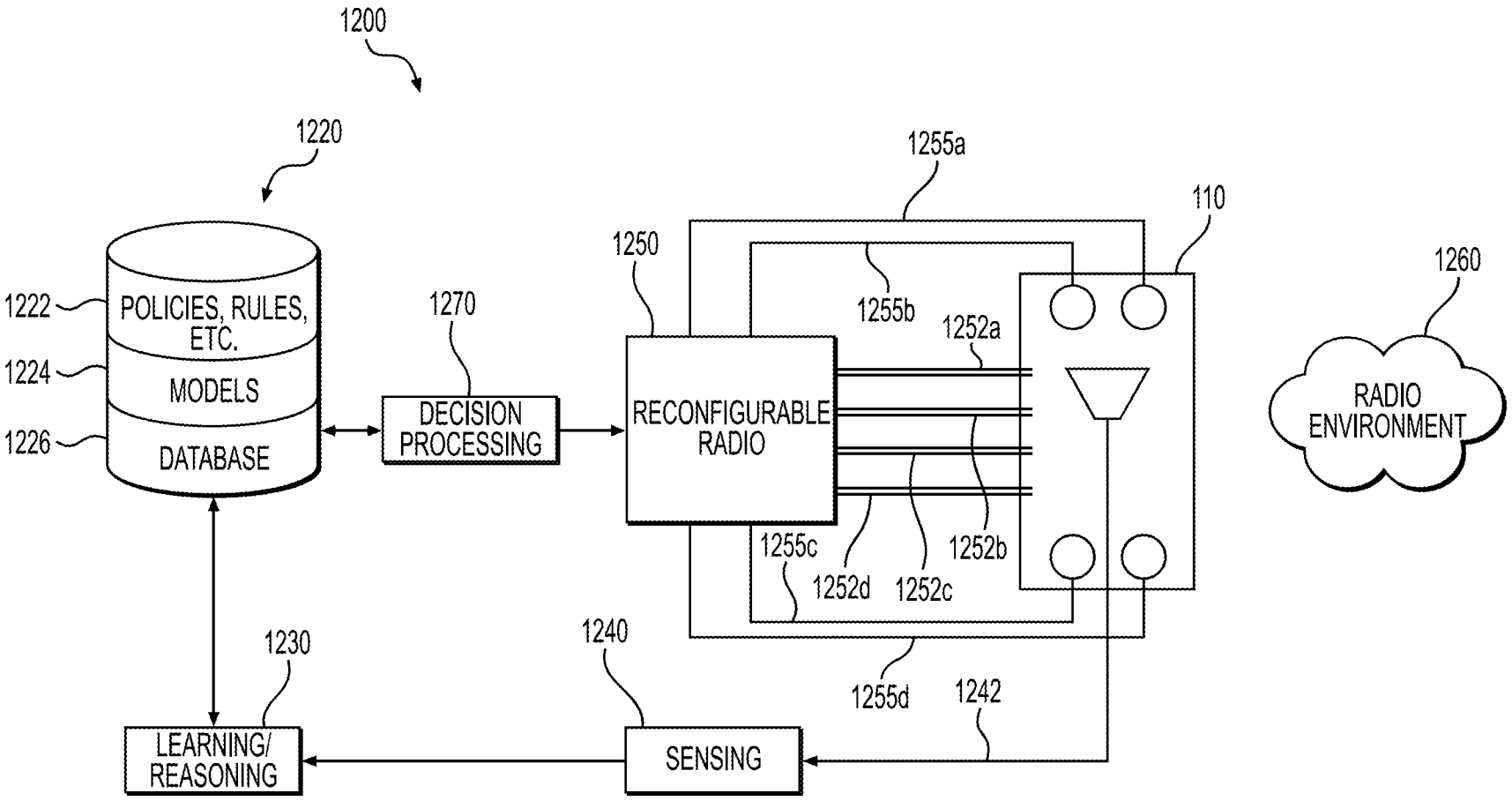
FIG. 12 is a schematic block diagram of an example cognitive radio in which the present inventive concept can be embodied.

FIG. 12 is a schematic diagram of an exemplary cognitive radio (CR) 1200 by which the present invention can be embodied. A CR is a dynamically configurable radio that detects available channels in a radio spectrum, then changes its transmission and/or reception parameters accordingly to afford more concurrent wireless communications over a given spectral band at a given location. CR 1200 utilizes planar antenna system 100 for its sensing antenna and for its transmit/receive antenna.

CR 1200 may include a suitable information storage device 1220 to store policies, rules, etc. 1222, such as spectral bands or frequencies to which the user has authorized access (licensed bands, etc.), geographic regions in which a set of regulations apply, situations in which transmit power must be limited, and so on. Storage device 1220 may also store radio resource utilization models 1224 that can be trained and utilized to determine a best radio resource utilization strategy based on a current radio environment 1260. Additionally, storage device 1220 may store a database 1226 containing information from which a radio resource utilization strategy can be derived based on a current state of radio environment 1260. Such a radio resource utilization strategy may include transmit/receive frequency bands, transmit power and so on.

Information storage device 1220 may be implemented by any quantity of any type of conventional or other memory or storage device, and may be volatile (e.g., RAM, cache, flash, etc.), or non-volatile (e.g., ROM, hard-disk, optical storage, etc.), and include any suitable storage capacity. The storage areas may be, for example, one or more databases implemented on a solid state drive or in a RAM cloud Sensing component 1240 may be electrically coupled to UWB sensing antenna 110 of planar antenna system 100 to obtain spectral information indicative of radio environment 1260. In one example, sensing component 1240 detects the occupancy state (occupied/unoccupied) of specific frequencies through suitable spectral analysis.

Learning/reasoning component 1230 may utilize information provided by sensing component 1240 and other available information in database 1220 to infer possible radio resource utilization strategies for given sets of conditions. Machine learning and artificial intelligence techniques may be brought to bear to determine a MIMO configuration that will achieve best transmission/reception characteristics based on a range of information including the current state of radio environment 1260. Radio resource utilization models 1224 are continually updated to assist in making a radio resource utilization decision. In certain embodiments, a radio resource utilization decision includes selecting a MIMO antenna configuration that includes specification of a set of voltages that are to be applied to a set of respective varactors. Decision processing component 1270 determines the best radio resource allocation based on the given state of radio environment 1260 and information stored in information storage device 1220. Such decision may be provided to reconfigurable radio component 1250 whereby the radio resource allocation is put into effect. For example, reconfigurable radio component 1250 may provide a voltage to each biasing network 160 of planar antenna system 100 on signal lines 1252*a*-1252*d* whereby each MIMO antenna element 125 is configured to transmit/receive using a frequency band that is appropriate to the MIMO configuration. Communication signals consistent with the MIMO configuration, e.g., transmit/receive signals of a selected frequency band, are conveyed to reconfigurable radio 1250 through transmission lines 1255*a*-1255*d* connected to planar antenna system 100 through, for example, coaxial connectors 170.

Learning/reasoning component 1230, sensing component 1240 and decision processing component, as well as certain circuits of reconfigurable radio 1250 may be realized by one or more data processing devices such as microprocessors, microcontrollers, systems on a chip (SOCs), or other fixed or programmable logic, that executes instructions for process logic stored the memory. The processors may themselves be multi-processors, and have multiple CPUs, multiple cores, multiple dies comprising multiple processors, etc.

Figure 13:
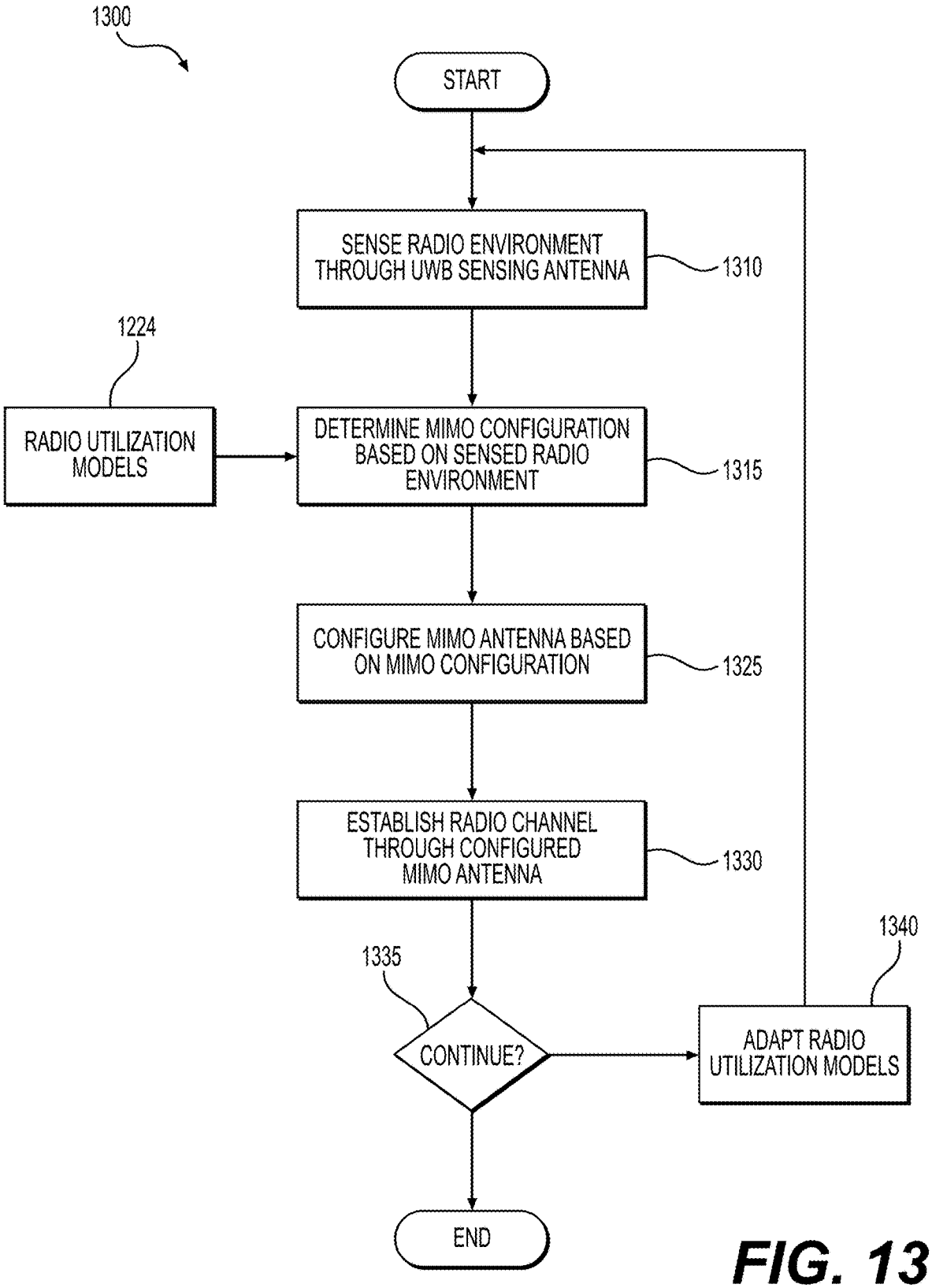
FIG. 13 is a flow diagram of an example cognitive radio process in which the present inventive concept can be embodied.

FIG. 13 is a flow diagram of a cognitive radio process by which the present invention can be embodied. In operation 1310, the radio environment is sensed through a UWB sensing antenna embodiment of the present invention. In operation 1315, a MIMO configuration is determined based on the sensed radio environment. Such determination may be made via radio utilization models 1224 that take as input a current sensed UWB spectrum and produce as output an appropriate MIMO configuration that includes a MIMO antenna configuration. The present invention is not limited to a particular machine learning technique by which a MIMO configuration is selected; numerous such techniques can be utilized in embodiments of the invention without departing from the spirit and intended scope thereof. In operation 1325, a MIMO antenna, such as that described above, may be configured, such as by applying voltages to respective varactors 115, based on the MIMO configuration determined in operation 1315. In operation 1330, a radio channel may be established through the configured MIMO antenna. In operation 1335, it is determined whether process 1300 should iterate. If so, process 1300 may transition to operation 1340, by which radio utilization models are adapted in accordance with the machine learning paradigm selected by a particular designer. Process 1300 may transition to operation 1310 and reiterate from that point.

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, method and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometime be executed in the reverse order, depending on the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

The invention claimed is:

1. A configurable antenna apparatus comprising:

a dielectric substrate having an upper surface and an opposing lower surface;

a upper conductor patch disposed on the upper surface of the substrate and a lower conductor patch disposed on the lower surface of the substrate;

a sensing antenna formed in the upper conductor patch; and an upper set of slot antennas formed in the upper conductor patch and a lower set of slot antennas formed in the lower conductor patch, wherein each of the slot antennas is loaded with a variable reactance component.

2. The apparatus of claim 1, wherein the slot antennas are annular slot antennas, each having a varactor diode connected across the corresponding slot as the variable reactance component.

3. The apparatus of claim 1, wherein each of the slot antennas include a central void.

4. The apparatus of claim 1 further comprising a transmission line disposed on an opposing side of the substrate of each of the slot antennas.

5. The apparatus of claim 1, wherein the upper conductor patch comprises a trapezoidal section forming a monopole antenna as the sensing antenna, the lower conductor patch being the reference plane of the monopole antenna.

6. The apparatus of claim 5, wherein the upper set of slot antennas is removed from the trapezoidal section.

7. The apparatus of claim 1, wherein a gap is formed between a distal end of the upper conductor patch and a distal end of the lower conductor patch.

8. The apparatus of claim 1, wherein each of the upper set of slot antennas and the lower set of slot antennas comprise a void in the corresponding upper conductor patch or lower conductor patch about which an electromagnetic field is generated in response to excitation from a corresponding transmission line.

9. A radio apparatus comprising:

a configurable antenna comprising:

a dielectric substrate having an upper surface and an opposing lower surface;

a upper conductor patch disposed on the upper surface of the substrate and a lower conductor patch disposed on the lower surface of the substrate;

a sensing antenna formed in the upper conductor patch;

an upper set of slot antennas formed in the upper conductor patch and a lower set of slot antennas formed in the lower conductor patch, wherein each of the slot antennas is loaded with a variable reactance component; and a configurable radio to select a band of frequencies on which to conduct communications, the configurable radio providing signals to the configurable antenna that tunes the configurable antenna to the band of frequencies.

10. The apparatus of claim 9, wherein the slot antennas are annular slot antennas, each having a varactor diode connected across the corresponding slot as the variable reactance component.

11. The apparatus of claim 9, wherein each of the slot antennas includes a central void.

12. The apparatus of claim 9 further comprising a transmission line disposed on an opposing side of the substrate of each of the slot antennas.

13. The apparatus of claim 9, wherein the upper conductor patch comprises a trapezoidal section forming a monopole antenna as the sensing antenna, the lower conductor patch being the reference plane of the monopole antenna.

14. The apparatus of claim 13, wherein the upper set of slot antennas is removed from the trapezoidal section.

15. The apparatus of claim 9, wherein a gap is formed between a distal end of the upper conductor patch and a distal end of the lower conductor patch.

16. The apparatus of claim 9, wherein each of the upper set of slot antennas and the lower set of slot antennas comprise a void in the corresponding upper conductor patch or lower conductor patch about which an electromagnetic field is generated in response to excitation from a corresponding transmission line.

17. A method comprising:

sensing a radio environment through a sensing antenna of an antenna system, the sensing antenna being formed in an upper conductor patch disposed on a dielectric substrate having an upper surface and an opposing lower surface, the upper conductor patch being disposed on the upper surface of the substrate and a lower conductor patch being disposed on the lower surface of the substrate;

determining a multiple-input multiple-output (MIMO) configuration based on the sensed radio environment;

configuring a MIMO antenna based on the MIMO configuration, the MIMO antenna comprising an upper set of slot antennas formed in the upper conductor patch and a lower set of slot antennas formed in the lower conductor patch, wherein each of the slot antennas is loaded with a variable reactance component to which a voltage is applied based on the MIMO configuration; and establishing a communication channel through the configured MIMO antenna.

18. The method of claim 17, wherein configuring the MIMO antenna includes applying the voltage to a varactor diode as the variable reactance component, the varactor diode being connected across an annular slot of the slot antennas.

19. The method of claim 17, wherein the MIMO configuration specifies the voltage that is applied to the variable reactance component of each of the slot antennas.

20. The method of claim 17, wherein each of the upper set of slot antennas and the lower set of slot antennas comprise a void in the corresponding upper conductor patch or lower conductor patch about which an electromagnetic field is generated in response to excitation from a corresponding transmission line.

* * * * *